US005083709A

United States Patent [19]

Iwanowski

[11] Patent Number: 5,083,709

[45] Date of Patent: Jan. 28, 1992

[54] LAWN IRRIGATION NOZZLE

[76] Inventor: Gary Iwanowski, 7419 Merrill Rd., Jacksonville, Fla. 32211

[21] Appl. No.: 568,469

[22] Filed: Aug. 16, 1990

[51] Int. Cl.[5] ..... B05B 1/14

[52] U.S. Cl. ..... 239/551; 239/555; 239/562; 239/581.1; 239/DIG. 1; 239/597; 251/304

[58] Field of Search ..... 239/DIG. 1, 581.1, 562, 239/555, 551, 538, 266, 200, 207, 581.2, 582.1, 443, 444, 597, 596; 251/121, 122, 304; 137/614.21

[56] References Cited

U.S. PATENT DOCUMENTS

| | | | |
|---|---|---|---|
| 561,065 | 5/1896 | Allen | 239/581.2 |
| 682,590 | 9/1901 | Greer | 239/581.2 |
| 1,179,709 | 4/1916 | Etnyre | 239/581.2 |
| 1,911,044 | 5/1933 | Thrasher | 137/614.21 |
| 2,530,808 | 11/1950 | Cerasi | 239/444 |
| 3,762,650 | 10/1973 | Radecki | 239/444 |
| 4,085,895 | 4/1978 | Curry et al. | 239/538 |
| 4,739,934 | 4/1988 | Gewelber | 239/444 |
| 4,850,538 | 7/1989 | Krahn | 239/562 |

FOREIGN PATENT DOCUMENTS

| | | | |
|---|---|---|---|
| 1528046 | 4/1968 | France | 239/DIG. 1 |
| 2502728 | 10/1982 | France | 251/304 |

*Primary Examiner*—Andres Kashnikow
*Assistant Examiner*—Christopher G. Trainor
*Attorney, Agent, or Firm*—Earl L. Tyner

[57] ABSTRACT

A lawn irrigation nozzle having a cylindrical body with a vertically disposed axis with two discharge ports on opposite sides of the body adapted to produce a horizontal spray from each discharge port, a manually rotatable disc adjacent each discharge port adapted to throttle the amount of water flowing outwardly from the discharge port, an inlet port at the bottom of the body, a threaded portion adjacent the inlet port for attaching the nozzle to an irrigation pipe, and a central axial threaded shaft means with a valve plug attached thereto and adapted to open or close the inlet port.

3 Claims, 5 Drawing Sheets

LAWN IRRIGATION NOZZLE

BACKGROUND OF THE INVENTION

It is well known that residential lawns, golf courses, etc. are frequently provided with irrigation systems which include a network of underground pipes and a plurality of nozzles strategically placed to provide a spray of water to the areas which are intended to be irrigated. Normally an electrical timing system is provided to actuate portions of the irrigation at my desired time of day and for any selected length of irrigation time.

The nozzles of today's systems are screwed onto threaded pipes of the irrigation system and have a central axial screw which can be rotated with a screw driver to open or close the water in the irrigation system to the nozzle. The spray pattern and direction in most nozzles is usually fixed and not adjustable. In the most recent designs the pattern has been made adjustable so as to narrow or broaden the pattern, just the nozzle is unidirectional. Furthermore different systems use different thread sizes and the nozzles may have male or female connections, thus making it very difficult to join accessories of different systems into any one irrigation structure. Accordingly, it is desirable to provide a nozzle that can be attached to any preexistive system.

It is an object of this invention to provide a novel lawn irrigation nozzle. It is another object of this invention to provide a novel bidirectional, adjustable pattern nozzle. Still other objects will become apparent from the more detailed description of this invention which follows.

BRIEF SUMMARY OF THE INVENTION

This invention relates to an irrigation nozzle having a generally cylindrical body, with a top, a bottom, and a cylindrical side wall; an inlet port in said bottom; and two discharge ports on opposite sides of said body; the body including two manually rotatable valve discs adapted to adjust the opening of said ports, respectively, internal passageway means in said body connecting said inlet port to said discharge ports, and means to attach said body to a water pipe.

In preferred embodiments of the invention, the nozzle includes a main shut-off valve including an axial screw-shaft which advances or withdraws a plug into or away from a seat in the inlet port; the adapter permits the nozzle to be attached to an irrigation system pipe that employs any type of thread size; the nozzle may also include a removable screen at the inlet port for preventing particulate material from entering the internal passageways.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
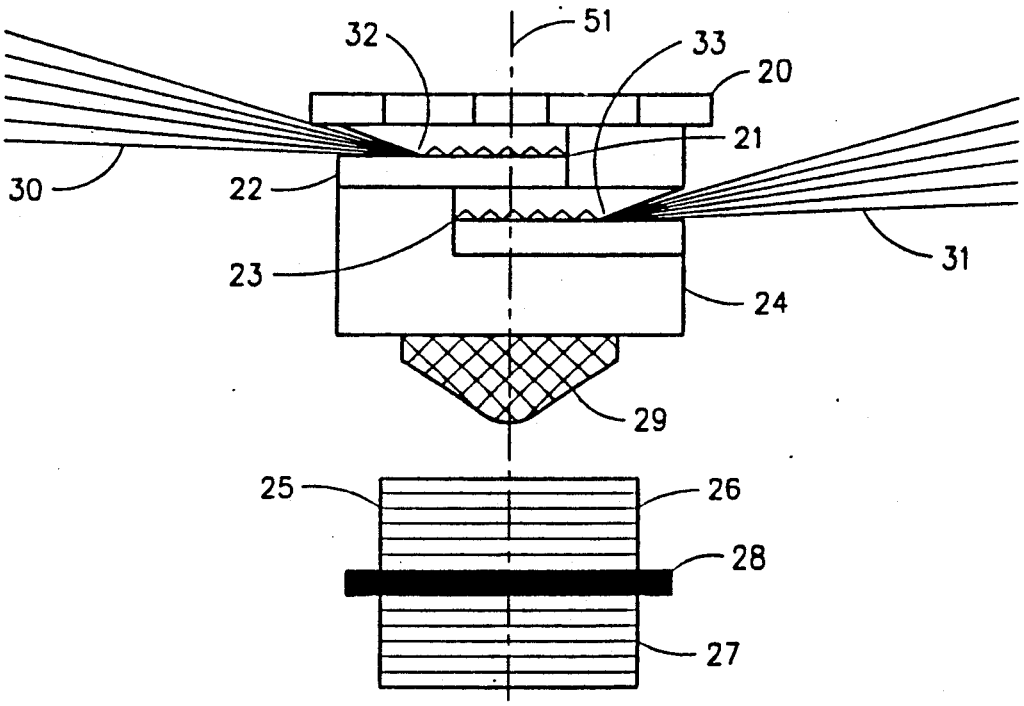
FIG. 1 is a front elevational view of the nozzle of the invention.
Figure 2:
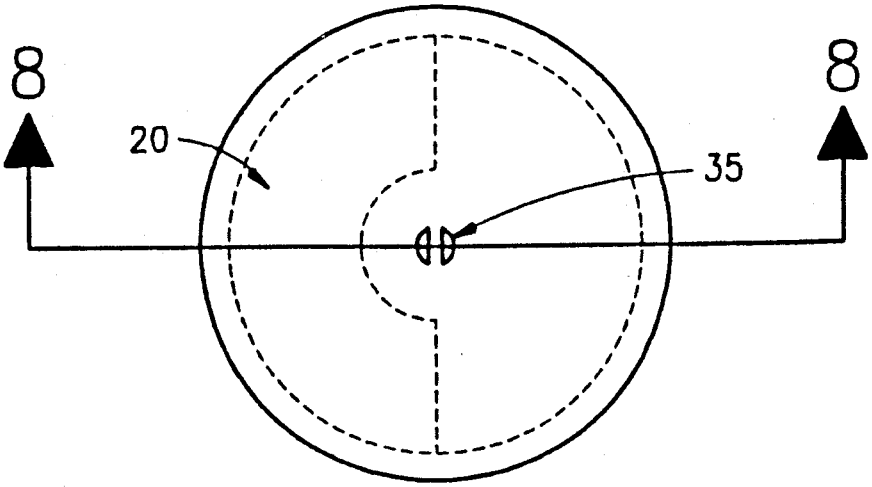
FIG. 2 is a top plan view of the nozzle of the invention.
Figure 3:
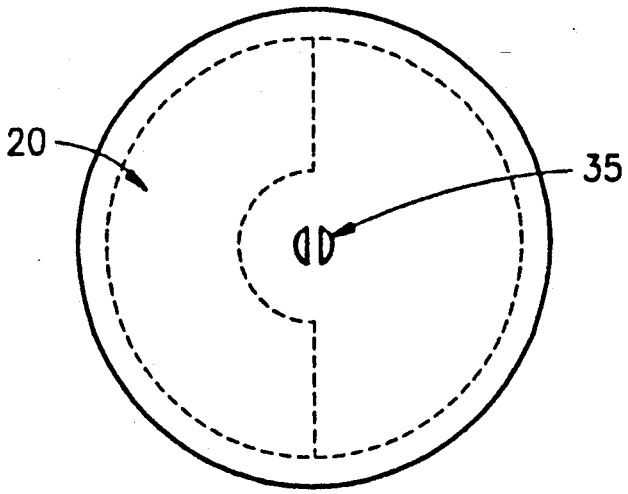
FIG. 3 is a top plan view of the nozzle cap of the nozzle of the invention.
Figure 4:
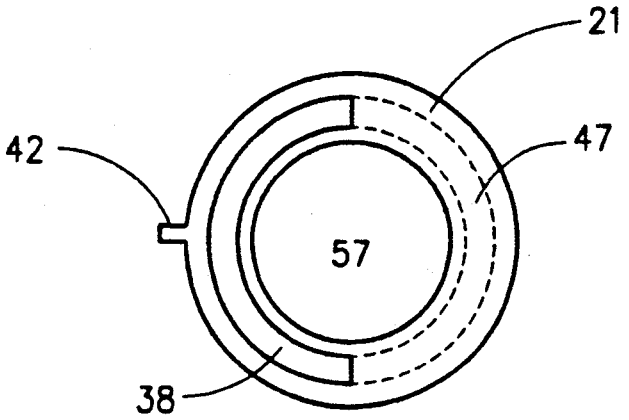
FIG. 4 is a top plan view of the upper valve disc of the nozzle of the invention.
Figure 5:
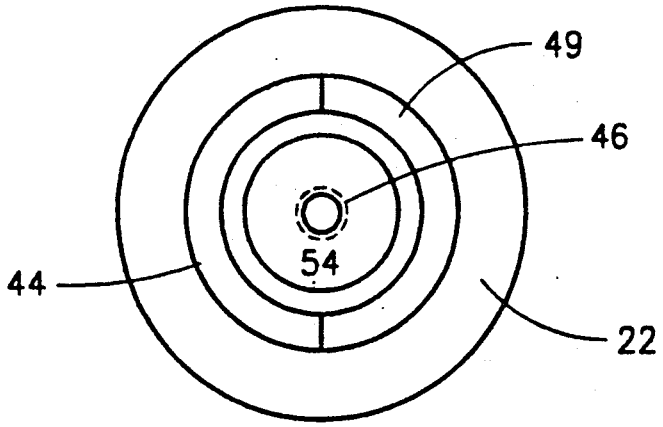
FIG. 5 is a top plan view of central plate of the nozzle of the invention.
Figure 6:
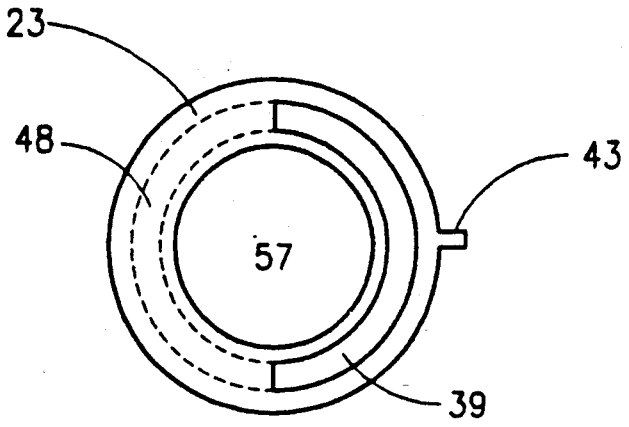
FIG. 6 is a top plan view of the lower valve disc of the nozzle of the invention.
Figure 7:
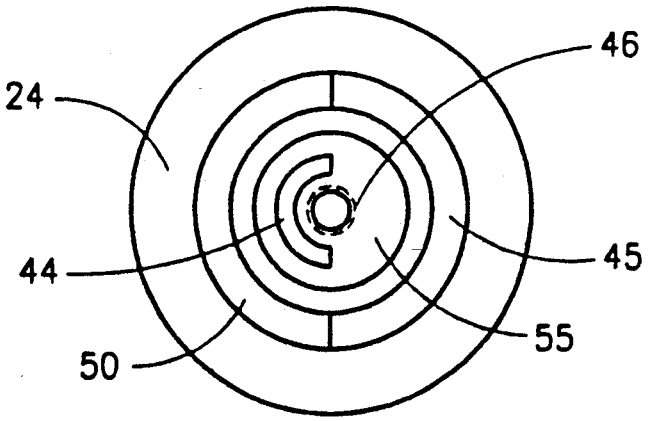
FIG. 7 is a top plan view of the lower plate of the nozzle of the invention.

The features of this invention are best understood by reference to the attached drawings. The nozzle is a generally cylindrical object with a vertical central axis 51. The nozzle has two vertically spaced discharge ports 32 and 33 positioned to produce an upper horizontal spray 30 and a lower horizontal spray 31 positioned on the opposite side of the nozzle body from upper spray 30. The lower plate 24 of the nozzle is internally threaded to receive adapter 25 having an exterior threaded portion 26 with threads to match those inside lower plate 24. The exterior threaded portion 27 has threads of a different size from those of portion 26. The particular size of the threads of portion 27 are those that will match a pipe coupling of the system to which this nozzle is to be attached. Grip 28 is a flange to make it easy to rotate adapter. There may be various combinations of threads on adapter 25 to provide the capability of coupling the nozzle to any pipe fitting.

In the preferred embodiment of this invention the nozzle body is comprised of five cylindrical sections assembled into a stack around an axial threaded shaft 35 having a valve plug 36 at the lower end which can be closed against valve seat 37. By turning shaft 35 with a screwdriver inlet port 34 of the nozzle may be opened or closed. Nozzle cap 20 is located on the top section of the stack. Upper valve disc 21 is the next section below nozzle cap 20. Central plate 24 is immediately below upper valve disc 21. Lower valve disc 23 is next below central plate 24. Lower plate 24 is the bottom section of the stack. Each of valve discs 21 and 23 may be rotated around central threaded shaft 35 to open or close irrigation water to produce sprays 30 and 31.

There are two separate internal passageways to carry water from inlet port 34 to discharge ports 32 and 33. Passageway 44 conducts water from inlet port 34 to upper discharge port 32. Passageway 45 conducts water from inlet port 34 to lower discharge port 33. Each valve disc has a semicircular slotted cut-out portion (38 in disc 21 and 39 in disc 23) which is aligned with interior passageways 44 and 45, respectively. Disc 21 may be rotated by pushing against finger tab 42. Disc 23 may be rotated by pushing against finger tab 43. Tabs 42 and 43 may be manipulated separately to open or close discharge ports 32 and 33, respectively.

Valve discs 21 and 23 each have a semicircular tongue on the lower surface thereof to fit into a similar semicircular track groove in the upper surface of the next lower plate section so as to provide a guide for turning discs 21 and 23. The semicircular tongue 47 on the lower surface of valve disc 21 slides in track groove 49 in the upper surface of central plate 23. Semicircular tongue 48 in valve disc 23 slides in track groove 50 in the upper surface of lower plate 24.

Water leaving upper discharge port 32 is directed against the conical deflector surface 40 on the lower surface of nozzle cap 20 causing the water to form horizontal spray 30. Similarly, water leaving lower discharge port 33 is directed against conical deflector surface 41 on the lower surface of central plate 22 to form horizontal spray 31. Conical surfaces 40 and 41 extend through a semicircular distance in line with semicircular slotted cutouts 38 and 39, respectively.

Screen 29 is a preferred item to be included in the nozzle of the invention. Screen 29 is intended to stop the passage of particulate matter in the irrigation water entering the nozzle. Particles cause malfunctioning of the nozzle and so the screen is a preferred inclusion. Screen 29 may be made in any shape or form to be used in the nozzle. The preferred embodiment here is a conical screen with a flange or other means to cause it to be held inside the lower end of lower plate 24 regardless of whether adapter 25 is attached to the nozzle body or not. For example, the flange in the screen may be adapted to be screwed into the internal threads 53 in lower plate 24, or it may be sufficiently flexible to be manually pinched and distorted sufficiently to be inserted into lower plate 24 and then to snap back into the original shape and be held in place by the internal threads in lower plate 24.

Figure 8:
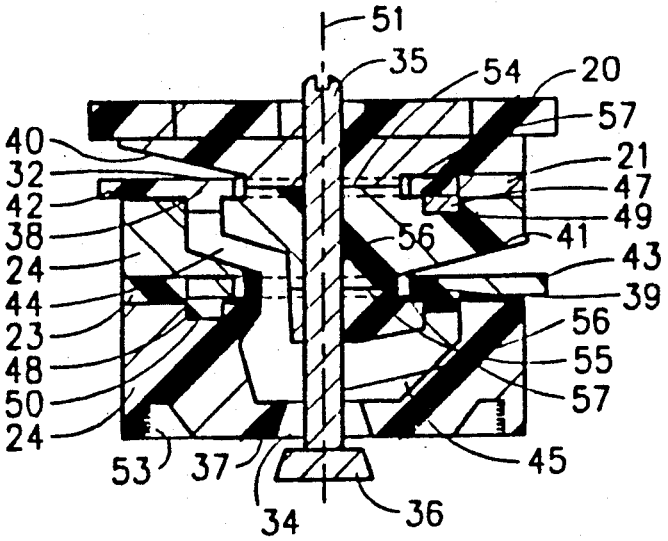
FIG. 8 is a cross-sectional view taken at 8—8 of FIG. 2.
Figure 9:
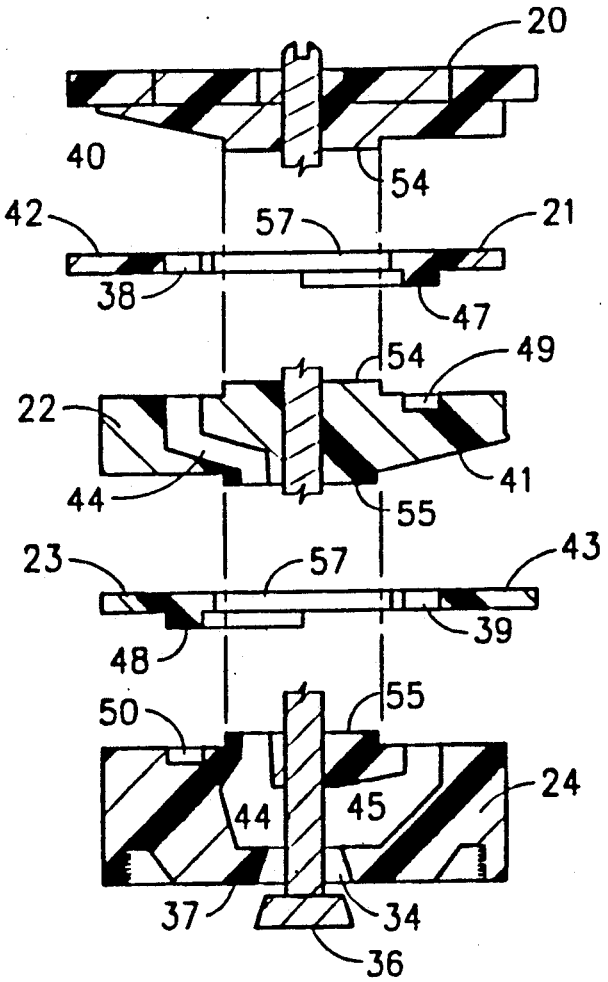
FIG. 9 is an exploded view of the cross-sectional view of FIG. 8.

Adapter 25 has an upper threaded portion 26 and a lower threaded portion 27 separated by a finger grip portion 28. Threaded portions 26 and 27 are made of different thread sizes and pitches so as to fit the nozzle of this invention onto irrigation systems using odd threaded sizes or pitches. Threaded portion 26 will mate with the internal threads 53 on the lower plate 24 (see FIG. 8).

The nozzle of this invention may be held together by adhering plate 20 to plate 22 and adhering plate 22 to plate 24. There is a central planar base on the bottom of plate 20 and the top of plate 24 that meet in plane 54 which may be used for cementing plate 20 to plate 22. Similarly there is a central base on the bottom of plate 22 and on the top of plate 24 that meet in plane 55 where cementing may be used to assemble plate 23 to plate 24. When plate 20 is adhered to plate 22 with valve disc 21 in place, disc 21 will be clamped in placed and put free to be rotated 360° to any location by reason of central bore 57 in discs 21 and 23 for closing, opening or throttling port 38 to adjust the spray 30 or desired. Similarly when disc 23 is inserted and plate 22 in cemented to plate 24, disc 23 is free to rotate through 360° to open, close or partly open port 39 and thereby adjust spray 31.

Threaded shaft 35 may be turned to cause plug 36 to open or close against valve seat 37 to shut off or open all water to the nozzle. Nozzle cap 20 is threaded to mate with shaft 35 while plates 22 and 24 are provided with a central drilled hole 50 that has no threads. Other designs may of course, be employed for inlet part 34 to mate a valve member to a valve seat.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. A lawn irrigation nozzle having a cylindrical body with a vertical longitudinal axis, a top, a bottom, and sides, an inlet port at said bottom, two laterally directed vertically spaced discharge ports located on opposite said sides of said body, two internal passageways connecting said inlet port to said discharge ports, respectively, said body comprising a vertical stack of five cylindrical portions mounted on a central axial threaded shaft having a plug at said bottom adapted to be seated in said inlet port to shut off access to said passageways; said five portions including in sequential order from said top to said bottom, a nozzle cap, a rotatable upper valve disc, a central plate, a rotatable lower valve disc, and a lower plate which is attachable to an irrigation water supply pipe, each said valve disc having a semicircular slotted cut-out portion aligned with one of said passageways, each said nozzle cap and said central plate having a conical surface aligned with one of said passageways and adapted to produce a horizontal spray of water from a vertical flow of water through one of said passageways.

2. The nozzle of claim 1 which additionally includes a tubular adapter having external threads thereon and being attached to and extending downwardly from said lower plate, said adapter being divided into an upper portion and a lower portion the threads on said upper portion of said adapter engaged with said lower plate being of a different size than the threads on said lower portion of said adapter extending outwardly of said lower plate.

3. The nozzle of claim 2 which additionally includes a screen mounted between said adapter and said lower plate and extending completely across the internal hollow of said adapter.

* * * * *